US005716252A

United States Patent [19]

Van Den Berg et al.

[11] Patent Number: 5,716,252

[45] Date of Patent: Feb. 10, 1998

[54] METHOD OF MANUFACTURING A SHADOW MASK OF THE NICKEL-IRON TYPE

[75] Inventors: Adrianus H.M. Van Den Berg; Albertus B. De Vries, both of Eindhoven, Netherlands

[73] Assignee: U.S. Philips Corporation, New York, N.Y.

[21] Appl. No.: 746,047

[22] Filed: Nov. 6, 1996

Related U.S. Application Data

[63] Continuation of Ser. No. 373,734, Jan. 17, 1995, abandoned.

[30] Foreign Application Priority Data

Jan. 17, 1994 [BE] Belgium ..... 9400049

[51] Int. Cl.[6] ..... H01J 9/14

[52] U.S. Cl. ..... 445/47; 313/402

[58] Field of Search ..... 445/37, 47; 313/402

[56] References Cited

U.S. PATENT DOCUMENTS

| | | | |
|---|---|---|---|
| 4,685,321 | 8/1987 | Van Den Berg et al. | 72/347 |
| 5,026,312 | 6/1991 | Van Den Berg | 445/47 |

FOREIGN PATENT DOCUMENTS

| | | | |
|---|---|---|---|
| 0561120 | 9/1993 | European Pat. Off. . | |
| 567989A1 | 11/1993 | European Pat. Off. | 313/402 |
| 3642205 | 1/1988 | Germany | 313/402 |
| 63-16525 | 1/1988 | Japan | 445/47 |
| 1-204333 | 8/1989 | Japan | 313/402 |
| 4074849 | 3/1992 | Japan . | |

*Primary Examiner*—P. Austin Bradley
*Assistant Examiner*—Jeffrey T. Knapp
*Attorney, Agent, or Firm*—Arthur G. Schaier

[57] ABSTRACT

A method of manufacturing a shadow mask of the nickel-iron type, in which an aperture-patterned sheet of a nickel-iron alloy comprising 35–37% by weight of Ni and less than 0.1% by weight of each constituent of the group of Mn, Cr and Si and at most 0.9% by weight of Co is given a thermal treatment for obtaining an ASTM grain number of ≧7, and the sheet thus obtained is given the desired shape of a shadow mask having a thermal expansion coefficient of $\leqq 0.9\times10^{-6}$/°C.

2 Claims, 2 Drawing Sheets

METHOD OF MANUFACTURING A SHADOW MASK OF THE NICKEL-IRON TYPE

This is a continuation of application Ser. No. 08/373,734, filed Jan. 17, 1995, now abandoned.

The invention relates to a method of manufacturing a shadow mask of the nickel-iron type for a color display tube.

A color display tube usually comprises an envelope having a glass display window which is provided with a display screen with phosphor areas luminescing in red, green and blue. At a short distance in front of the display screen, a shadow mask provided with a large number of apertures is mounted in the tube. When the tube is operated, three electron beams are generated therein by an electron gun system, which beams are incident on said phosphor areas through the apertures in the shadow mask. The mutual position of the apertures with respect to the phosphor areas is such that each electron beam impinges upon phosphor areas of one color when the picture is being written. A great part of the electrons is, however, incident on the shadow mask, at which the kinetic energy of these electrons is converted into heat and the temperature of the shadow mask rises. The thermal expansion of the shadow mask caused by this increase of temperature may lead to a local or complete doming of the shadow mask so that the mutual positions of the apertures in the shadow mask and the phosphor areas associated with these apertures are disturbed (see FIG. 3). This results in color errors in the displayed picture, which errors are more serious as the shadow mask is less convex (as is more and more the case in the current generation of color display tubes with their flatter display windows) and/or the distance between the apertures is smaller (as in High Resolution color display tubes).

It is known per se that such problems caused by thermal effects can be alleviated by manufacturing the shadow mask from a material having a low thermal expansion coefficient. Such a material is, for example an iron base alloy containing from 34–38% by weight of nickel, which exhibits the so-called invar effect. However, the high proof stress, hence difficult mechanical processibility of these alloys impede their application. It is known from United States Patent U.S. Pat. No. 4,685,321 (EP-A 179 506) to subject a shadow mask sheet of such a material first to a thermal treatment so as to decrease the 0.2% proof stress at ambient temperature and to effect the process of formation above ambient temperature so as to further decrease the 0.2% proof stress. The nickel-iron material used in this method has a thermal expansion coefficient of approximately 1 to $1.5.10^{-6}$/°C. Lower coefficients of expansion can be obtained by replacing a part of the Ni by a substantial quantity of Co (2–12% by weight).

A drawback of the use of a substantial quantity of material comprising Co is not only its high cost but also contamination of the etchant with Co during etching.

It is, inter alia an object of the invention to provide a method of manufacturing a shadow mask of the nickel-iron type (having an unincreased Co content) which leads to a shadow mask of a material having a lower coefficient of expansion (particularly lower than $0.9\times10^{-6}$/°C.) and a relatively small grain size.

A method of the type described in the opening paragraph is therefore characterized by the following steps:

providing an aperture-patterned sheet of a material comprising:

C≦0.01% by weight

Si≦0.1% by weight

Cu≦0.1% by weight

Al≦0.01% by weight

Cr≦0.1% by weight

Ni 35–37% by weight

Co≦0.9% by weight an amount of Mn ≦0.1% by weight remainder Fe and impurities unavoidably coming into said material during the course of production thereof;

subjecting the sheet to a thermal treatment for obtaining an average grain size according to an ASTM grain number of ≧7 and preferably of ≧7.5, which grain number is defined by the ASTM standard ASTM E112-88, 12.4;

forming the sheet after the thermal treatment for forming a shadow mask.

The above-mentioned composition is such that the thermal expansion coefficient $\alpha_{20-100}$ (after the thermal treatment) in the temperature range of 20°–100° C. is between 0.5 and $0.9.10^{-6}$/°C. Particularly, values in the range between 0.5 and $0.8.10^{-6}$/°C. can be realised, for which purpose at least one of the Mn and the Si contents is chosen to be ≦0.05% by weight.

The invention is based, inter alia on the recognition that where small amounts of Co hardly influence the linear coefficient of expansion, and larger amounts of Co even tend to decrease the coefficient of expansion, certain other ingredients normally present in Ni—Fe alloys for shadow masks, to wit Cu, Cr, Mn, Si, C and Al, increase the thermal expansion coefficient to an increasing extent (See FIGS. 4A and 4B). In conventional nickel-iron alloy shadow-mask sheets the Al and C contents are maintained at a low level, but the invention specifically relates to the use of alloys in which also the Si and Mn (and Cr) contents are low. Notably the Mn content is relatively high in conventional NiFe alloys for shadow masks and is generally considerably higher than 0.1% by weight. (In commercial alloys 0,3–0,5% by weight). The Cu content is less critical because, among all mentioned ingredients, Cu raises the linear coefficient of expansion to the smallest extent.

The thermal treatment is such that the grains of the apertured sheet, which have an elongate shape after rolling of the sheet (of between 100 and 200 μm thickness) are broken into parts, which parts subsequently do not grow substantially. As will be explained hereinafter, it is desirable for certain uses that the grain size is below 30 μm.

A suitable thermal treatment is performed by heating the sheet to a temperature of between 750° and 850° C. in a preferably non-oxidizing gas atmosphere (for example, a gas atmosphere comprising nitrogen or hydrogen, or nitrogen and hydrogen).

The invention also relates to a cast and rolled nickel-iron alloy strip having a thermal expansion coefficient of less than $0.9.10^{-6}$/°C. and particularly less than or equal to $0.8.10^{-6}$/°C., of a material comprising:

C≦0.01% by weight

Si≦0.1% by weight

Cu≦0.1% by weight

Al≦0.01% by weight

Cr≦0.1% by weight

Ni 35–37% by weight

Co≦0.9% by weight an amount of Mn ≦0.1% by weight remainder Fe and impurities unavoidably coming into said material during the production thereof. Such impurities are e.g. O, N, P and S in this connection.

The invention further not only relates to a shadow mask sheet manufactured from an alloy strip as described above, but also to a shadow mask frame manufactured from an alloy strip as described above, while such an alloy strip may also advantageously be used in other, display tube or non-display tube applications).

The above-mentioned ASTM grain size number 7 corresponds to a diameter of avenge grain section of 32 μm. These relatively small grain sizes have the effect that apertured shadow mask sheets can be made with a very small distance between the apertures, i.e. with very narrow dams. This is particularly important for uses in (HD)TV display tubes.

These and other aspects of the invention will be apparent from and elucidated with reference to the embodiments described hereinafter.

In the drawing

Figure 3:
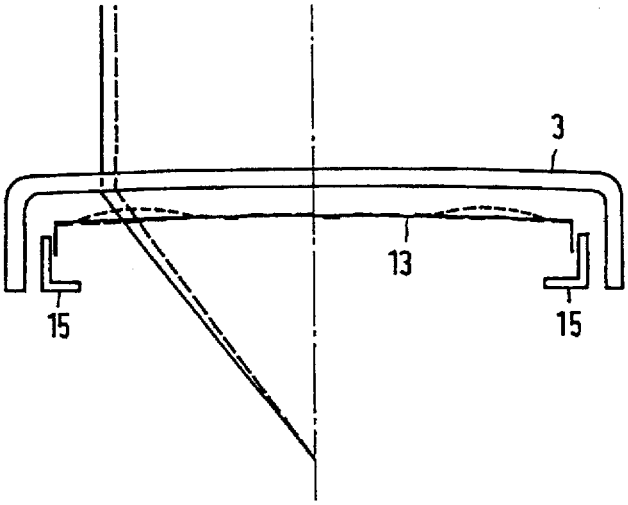
Figure 4A:
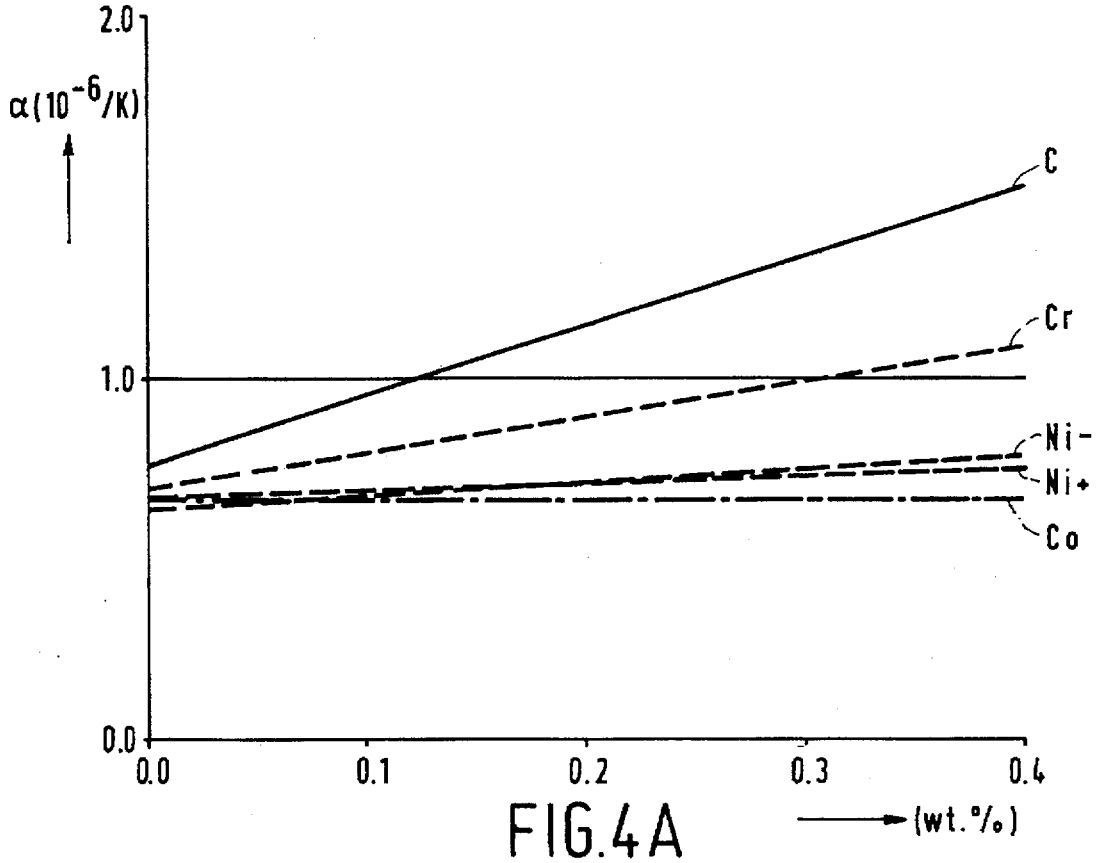
Figure 4B:
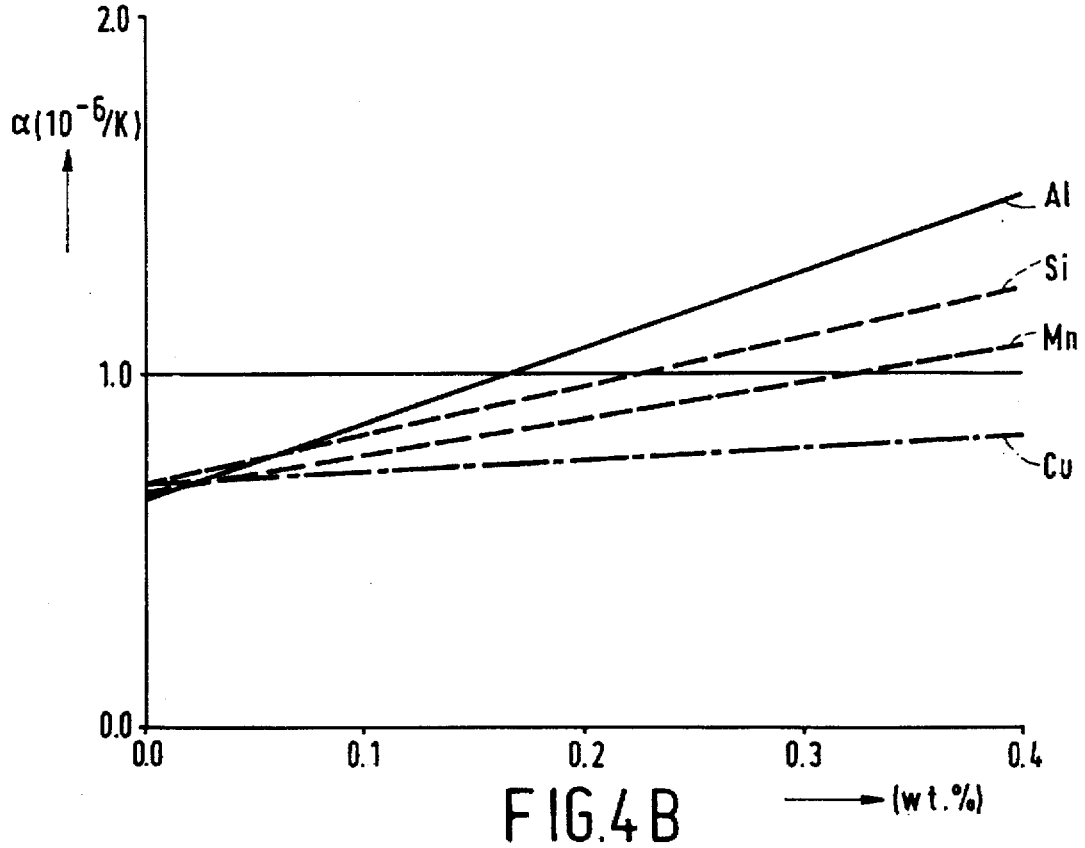

FIG. 3 schematically shows the effect of local doming;

FIGS. 4A and 4B graphically shows the results of an investigation carried out in the framework of the invention.

The figures are not drawn to scale. In the figures, corresponding parts generally bear the same reference numerals.

A cathode ray tube, in this example colour display tube 1, comprises an evauated envelope 2 which consists of a display window 3, a cone portion 4 and a neck 5. In the neck 5 there is provided an electron gun 6 for generating three electron beams 7, 8 and 9 which extend in one plane, the in-line plane, in this case the plane of the drawing. A display screen 10 is situated on the inside of the display window. Said display screen 10 comprises a large number of phosphor elements luminescing in red, green and blue. On their way to the display screen 10, the electron beams 7, 8 and 9 are deflected across the display screen 10 by means of deflection unit 11 and pass through a colour selection electrode 12 which is arranged in front of the display window 3 and which comprises a thin sheet 13 having apertures. The colour selection eletrode 13 arranged on a frame 15 which is suspended in the display window by means of suspension means 14. The three electron beams 7, 8 and 9 pass through the apertures 13 of the colour selection electrode at a small angle and, consequently each electron beam impinges on phosphor elements of only one colour. What happens in the case of local doming is shown in FIG. 3.

Figure 2:
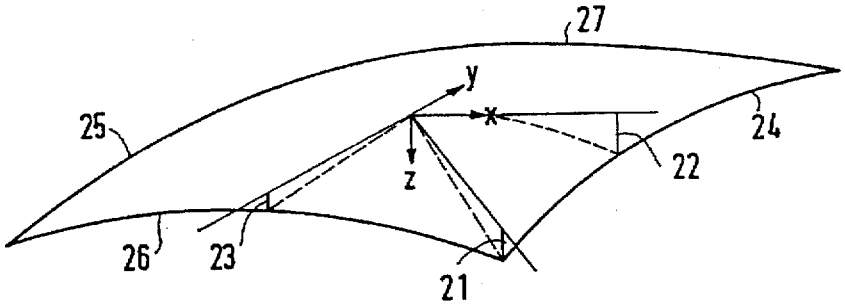
FIG. 2 is a partly perspective view of a display window.

FIG. 2 is a partly perspective view of a surface of a display window. The points of the surface can be described by a function z=f(x,y), where z is the distance between a point and the tangent plane to the centre of the surface, and x and y are the customary denominating letters for the coordinates of a point on the surface. z Is commonly termed the sagittal height. $y_{mas}$ Is the y-coordinate of a point at the end of the short axis, and of points having an equal y-coordinate. $x_{mas}$ Is the x-coordinate of a point at the end of the long axis, and of points having an equal x-coordinate. The z-axis extends perpendicularly to the tangent plane in the centre of the surface of the display window and is indicated in the Figure. The short axis is referred to as the y-axis, the long axis is referred to as the x-axis. Said axes extend perpendicularly to each other and to the x-axis. Both the inner surface and the outer surface can be described in such a manner. In any cases the inner surface have substantially the same shape. In FIG. 2, the sagittal height $x_{max}$ in the corners is indicated by line segment 21 and the sagittal height at the end of the long axis $z_{max}(x_{max},O)$ and the sagittal height at the end of the short axis $z_{max}(O,y_{max})$ by line segments 22 and 23, respectively. The ends of the short and long axes are given by the extreme points of the raster in the x-direction and y-direction, respectively.

Figure 1:
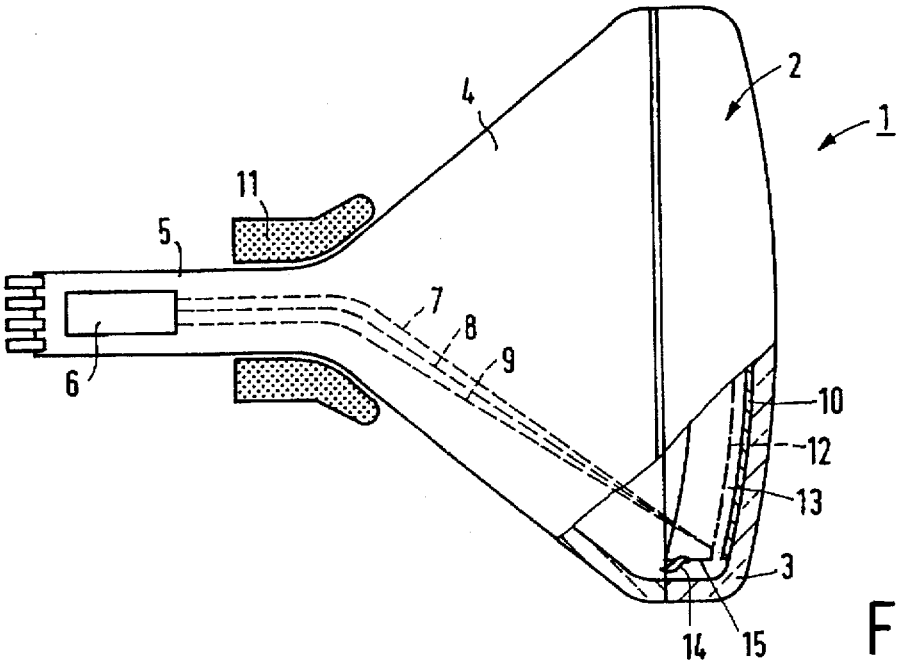
FIG. 1 is a sectional view of a cathode my tube.

Such a surface z(x,y) can be characterized to a considerable degree by means of:

1. The avenge radius of curvature along the diagonal $R_{diag}$
2. The relative sagittal height in the corner, RSH.
3. The variation of the radius of curvature $R_x$ along the long axis, i.e. the X-axis.
4. The variation of the radius of curvature $R_y$ along the short axis, i.e. the Y-axis. The ratio of the avenge radius of curvature $R_{diag}$ of the outside surface along the diagonal, i.e. the avenge radius of curvature from the centre to the corner, and the length D of the diagonal is representative for the flatness type of the display window. In practice the FIG. 1.74×D is used as a reference dimension (1.74×D= "R"). The avenge radius of curvature along the diagonal can be calculated from the sagittal height at the end of the diagonal ($z_{max}$):

$$(R_{diag}-z_{max})^2+D^2/4=R^2_{diag}.$$

Flatter constructions result in a larger average radius of curvature along the diagonal and hence, in a proportionally reduced sagittal height in the corners, $z_{max}=z(x_{max},y_{max})$. The present invention relates in particular to shadow masks for crt's having a relatively flat display window, i.e. a display window having a relatively large radius of curvature along the diagonal. For commercial Flat (Square) tubes it holds that $R_{diag}\approx 1.5\times 1.74\times D$, while the display window of a Super Flat tube has a radius of curvature along the diagonal ($R_{diag}$) which is greater than 1,5×1.74×D, $R_{diag}\approx 2\times 1.74\times D$ being representative for most commercial SF-tubes, and $R_{diag}\approx 2.5\times 1.74\times D$ being representative for Ultra SF tubes.

A strip having a thickness of approximately 150 microns is obtained by rolling of an ingot from a (Fe-36 Ni) alloy containing 0.01% by weight of carbon, 0.08% by weight of silicon, 0.047% by weight of manganese. Patterns of apertures are etched in this strip by means of a photo-etching process. These apertures may have any desired shape such as, for example slotted or circular shapes. After etching of the apertures, the strip in which also scratch lines have been etched, is divided into pieces each constituting a shadow mask sheet provided with a pattern of apertures. The material of the shadow mask sheet thus obtained has a 0.2% proof stress of between 600 and 660N/mm$^2$ at ambient temperature. This value is too high to give the shadow mask sheet the desired shape. To decrease this value, the shadow mask sheet is annealed for approximately 15 minutes in a hydrogen-containing gas atmosphere (10% $H_2$, remainder $N_2$) at a temperature of approximately 750° C. A material having a grain size of 18 μm, a coercive force of approximately 50 A/m and a coefficient of expansion of $\leqq 0.8.10^{-6}$/°C. is obtained between 20° and 100° C. The achieved 0.2% proof stress of 280 N/mm$^2$ is, however, still too high to obtain a reproducible process for shaping the shadow mask sheet. To this end a further decrease of the 0.2% proof stress is necessary. To realise this, the shadow mask sheet is not shaped at ambient temperature, but at a temperature of between 50° C. and 250° C. At 200° C., the 0.2% proof stress is approximately 120N/mm$^2$.

Comparable results were obtained with a (Fe-36 Ni) material comprising less than 0.01% by weight of C, 0.059% by weight of Si, 0.058% by weight of Mn. Here the grain size after the thermal treatment was 20 μm, the magnetic coercive field strength was approximately 40 A/m and the coefficient of expansion was also $\leqq 0.8\times10^{-6}$/°C. It is to be noted that generally some Co (<0.3% by weight) is naturally present in nickel-iron alloys, because it is very difficult to separate Co from Ni. The invention allows a deliberate addition of Co up to a total content of 0.9% by weight. This is favourable for obtaining a low coefficient of expansion, while the etching process is not noticeably affected. For optimal etching the Co content is <0.5% by weight and particularly <0.13% by weight. Moreover, coercive field strengths of <55 A/m appear to be feasible, which is important in connection with the demagnetizing process of the shadow mask which is carried out e.g. each time the tube is put into operation. The resultant shadow masks, which have linear coefficients of thermal expansion $\alpha_{20-100}\leqq 0.8\times10^{-6}$/°C. are found to exhibit approximately 25% less local doming and approximately 30% less teletext doming than comparable shadow masks of a conventional nickel-iron material of the Invar® type. Since local doming is particularly manifest at the edge of the shadow mask, it used to be common practice in the use of conventional nickel-iron alloys to have such a mask design that the luminance declined towards the edge (smaller apertures in a direction from the centre towards the edge). The use of the invention provides the possibility of decreasing the size of the apertures towards the edge to a smaller extent, which results in less decline of luminance towards the edge. A successful use is, for example the one in 29" SF display tubes. (A decrease of 15% when using a conventional nickel-iron material, a decrease of e.g. 10% when using a nickel-iron material according to the invention).

The advantage of the invention may also be utilized in another way. If the size of the aperture decreases towards the edge to an extent which is equal to that for the use of conventional nickel-iron alloys, it will be possible to use a flatter shadow mask design without any problems. This means, for example that a mask designed for use in flat (square) tubes can be used for superflat (SF) tubes, or a mask designed for use in SF tubes can be used for Ultra SF tubes.

Another advantage of the invention is that a shadow mask coating by means of a layer inhibiting heating due to electron bombardment (such as coatings with a $Bi_2O_3$ layer, an $Al_2O_3$ layer or a lead borate glass-containing layer) can be dispensed with.

The invention relates to shadow masks having a pattern of circular apertures or a pattern of elongate apertures, while in the latter case each aperture may extend both across a small part of the height and across the entire height of the shadow mask.

In summary, the invention thus relates a.o. to a method of manufacturing a shadow mask of the nickel-iron type, in which an aperture-patterned sheet of a nickel-iron alloy comprising 35–37% by weight of Ni and less than 0.1% by weight of each constituent of the group of Mn, Cr and Si, the amounts of Mn, Cr and Si being selected such that the linear coefficient of thermal expansion $\alpha_{20-100}$ is $\leqq 0.9\times10^{-6}$/°C. and preferably $\leqq 0.8\times10^{-6}$/°C., and at most 0.9% by weight of Co is given a thermal treatment for obtaining an ASTM grain number of ≧7, and the sheet thus obtained is given the desired shape of a shadow mask. In this connection FIGS. 4A and 4B show the influence which each of the consitutents C, Al, Mn, Si, Cr, Cu and Co has on the temperature coefficient of linear expansion $\alpha_{20-100}$ if added to a $FeNi_{36.15}$ alloy. By $FeNi_{36.15}$ alloy is meant a substantially pure Ni—Fe base alloy which comprises 63.85% by weight Fe and 36.15% by weight Ni. The $Ni^+$ line relates to Ni—Fe alloys which comprise from 0 to 0.4% by weight more Ni than the base alloy and the $Ni^-$ line relates to Ni—Fe alloys which comprise from 0 to 0.4% by weight less Ni than the base alloy. (If it can be made pure enough $FeNi_{36.15}$ has the lowest $\alpha_{20-100}$ of the Invar® type nickel-iron alloys). Experimental data are presented in the table below.

TABLE

| | Coefficient of linear expansion (20–100° C.) $FeNi_{36.15}$ + alloying elements Alloying elements | | | | | | | | |
|---|---|---|---|---|---|---|---|---|---|
| Concentration Wt. % | C | Cr | $Ni^-$ | $Ni^+$ | Co | Al | Si | Mn | Cu |
| 0 | 0.67 | 0.67 | 0.67 | 0.67 | 0.67 | 0.67 | 0.67 | 0.67 | 0.67 |
| 0.1 | 1.00 | 0.75 | | | 0.71 | 0.94 | 0.81 | 0.83 | 0.67 |
| 0.1 | 1.05 | 0.74 | | | | 0.83 | 0.88 | | 0.80 |
| 0.2 | | | | | | | | | |
| 0.3 | 1.30 | 1.15 | 0.71 | 0.74 | 0.62 | 1.33 | 1.15 | 0.91 | 0.83 |
| 0.3 | | 1.02 | | | | 1.2 | 1.10 | | |
| 0.4 | | | | | | | | | |
| 0.5 | | | | | | | | | |
| 0.6 | | | | | | | | | |
| 0.7 | | | 0.95 | 0.87 | | | | | |
| 0.8 | | | | | | | | | |
| 0.9 | | | | | | | | | |
| 1.0 | | 1.62 | 1.03 | 0.89 | 0.71 | 2.87 | 2.07 | 1.73 | 1.10 |
| 1.0 | | 1.71 | | | | 2.77 | 2.08 | | 1.03 |

It was found that if (Fe-36-15 Ni) is taken as the base alloy, and the Ni-amount does not vary more than 0.25% by weight, $\alpha_{20-100}$ can be kept below $0{,}9\times10^{-6}$/°C. if the following limits are not surpassed:

C: 0.005% by weight
Al: 0.01% by weight
Mn: 0.1% by weight
Cr: 0.05% by weight
Si: 0.1% by weight
Cu: 0.1% by weight It is to be noted that if it is ensured that the basic sheet for the shadow mask comprises the above-described very small quantities of Si, Mn and Cr in particular, this appears to lead to a sheet having a more homogeneous crystal structure so that notably its etchability improves. This is important in the manufacture of shadow mash for color monitor tubes, which masks must be provided with a very large number of apertures with narrow interspaces.

We claim:

1. A method of manufacturing a shadow mask of the nickel-iron type having a coefficient of expansion $\leqq 0.9\times10^{-6}$/°C., said method comprising:

providing an aperture-patterned sheet of a material having:

C≦0.01% by weight

Si≦0.1% by weight

Cu≦0.1% by weight

Al≦0.01% by weight

Cr≦0.1% by weight

Ni 35–37% by weight

Co≦0.9% by weight an amount of Mn greater than zero and less than or equal to 0.1% by weight and a remainder Fe and impurities unavoidably coming into said material during the production thereof;

subjecting the sheet to a thermal treatment for obtaining an ASTM grain number of ≧7.0, which grain number is defined by the ASTM standard ASTM E112-88, 12.4; and forming the sheet after the thermal treatment to form a shadow mask.

2. The method as claimed in claim 1, and including the step of performing the thermal treatment at a temperature of between 750° and 850° C. in a non-oxidizing gas atmosphere.

* * * * *